US006375300B1

(12) United States Patent
Freedman

(10) Patent No.: US 6,375,300 B1
(45) Date of Patent: Apr. 23, 2002

(54) INTERLEAVE PULSE MODULATION FOR THERMAL PRINTERS

(75) Inventor: Sharon Corinne Freedman, Morrisville, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/477,579

(22) Filed: Jan. 4, 2000

(51) Int. Cl.[7] ..... B41J 29/393; B41J 29/38; B41J 2/205

(52) U.S. Cl. ..... 347/19; 347/10; 347/11; 347/12; 347/14; 347/15

(58) Field of Search ..... 347/19, 12, 10, 347/11, 14, 23, 15

(56) References Cited

U.S. PATENT DOCUMENTS

| | | | | |
|---|---|---|---|---|
| 4,806,950 A | | 2/1989 | Sekine et al. | 346/76 PH |
| 5,109,235 A | | 4/1992 | Sasaki | 346/76 PH |
| 5,144,336 A | | 9/1992 | Yeung | 346/76 PH |
| 5,339,099 A | | 8/1994 | Nureki et al. | 346/76 PH |
| 5,365,257 A | | 11/1994 | Minowa et al. | 346/76 PH |
| 5,548,319 A | | 8/1996 | Kwon | 347/183 |
| 5,608,442 A | | 3/1997 | Bennefeld et al. | 347/211 |
| 5,790,140 A | * | 8/1998 | Koizumi et al. | 347/12 |

* cited by examiner

*Primary Examiner*—John Barlow
*Assistant Examiner*—Charles W. Stewart, Jr.
(74) *Attorney, Agent, or Firm*—Winstead, Sechrest & Minick, LLP; J. Bruce Schelkopf

(57) ABSTRACT

A printer and method for shortening printing time is provided for in-line thermal printers using two banks of print elements. Electric currents to the banks are interleaved together. Interleaving provides the advantages of pulse modulation, but with an improved print speed. In the preferred embodiment of the invention, a first set of printing elements is supplied with a first current signal for heating up the first set of printing elements up to the printing temperature. Then, the first set of printing elements is supplied with a series of shorter current signals to retain the temperature of the first set of printing elements until a first bank of dots is printed. Interleaved between the first series of shorter current signals, is a second series of short current signals supplied to the second set of print elements to heat up the second set of printing elements up to the printing temperature. After completion of the second series of signals, a final current signal is supplied to the second set of printing elements to retain the printing temperature of the second set of printing elements to print a second bank of dots. The row of dots is printed when both banks of dots have been printed. This process is repeated until the entire row of characters is printed on the media.

47 Claims, 5 Drawing Sheets

INTERLEAVE PULSE MODULATION FOR THERMAL PRINTERS

TECHNICAL FIELD

The present invention relates in general to a thermal dot printer, and in particular to a thermal dot printer and a method for controlling a thermal dot printer using interleave pulse modulation for heating up the printing elements of the thermal printhead of the thermal dot printer.

BACKGROUND INFORMATION

Various kinds of dot printers are known in the art. So-called thermal dot printers employ thermal energy to form images or characters on a media. Generally speaking, such thermal dot printers operate by either applying thermal energy to the media or to a heat sensitive coating on the surface of the media to alter the characteristics of the media or the characteristics of the heat sensitive coating, or by thermally energizing a thermally sensitive hot melt wax ink ribbon to transfer ink from the ribbon to the media.

Typically, a thermal dot printer contains a thermal printhead for printing characters or images on a media, a drive system for moving the paper across the printhead, a print logic for outputting character print signals to the printhead, and optionally, a drive system for moving the printhead across the paper.

The thermal printhead usually includes a plurality of print positions arranged in either vertical or horizontal lines. Each print position includes a printing element connected to wires. When electrical power is applied to the wires, the printing element increases in temperature. At a certain temperature, the printing element causes a visible dot to appear on the media being printed. A group of closely spaced dots represents a character or symbol.

When using a conventional thermal matrix printer in which the printing elements of the thermal matrix printhead are arranged in the form of a matrix, the printing elements are selectively heated to form a character as the thermal matrix printhead travels in the printing direction at a predetermined pitch across the paper or medium path. As such, one character is formed by the group of dots each time the thermal matrix printhead is traveled by a predetermined number of dots. Once an entire row of characters is printed, the paper advances so that another row of information can be printed as the process is repeated.

While conventional thermal matrix printers are still used in some applications, modern printers are more likely to employ a thermal in-line printhead. A thermal in-line printhead is a stationary printhead that uses a series of dot printing elements configured in a horizontal line across the width of the paper. As such, the printhead remains stationary with respect to the paper. The number of printing elements is a function of the print quality and the width of the paper. As opposed to a thermal matrix printer, which prints a single character then moves a predetermined amount before printing another character, an in-line printhead selectively prints a horizontal row of dots across the paper at once. The drive system, comprising a stepper motor and a system of gears and rollers, continuously moves the print media at a predetermined rate along a paper path allowing the sequential printing of multiple rows of dots. Thus, all the characters in the row are formed as multiple rows of dots are printed across the media.

A typical in-line printhead may have several hundred print elements. Typically these elements are divided into groups of elements. For example, a printhead configuration of 640 elements might be divided into five groups of 128 elements. Each of the five groups could be activated separately with separate control lines. Separate control lines are desirable because the power required to activate all 640 elements exceeds the capacity of power supplies typically used in in-line printers. With typical power supplies, three groups of elements can be activated at a time. Thus, in a printhead configuration of 640 elements, it is possible to combine the control lines into two "banks" of groups. The first bank contains three groups of elements (or 384 elements comprising the left column of the paper) and the second bank contains two groups of elements (or 296 elements comprising the right column of the paper). Both banks of elements are used to print one row of 640 dots.

For printing a first row of dots, therefore, a first set of printing elements is activated in the first bank of elements. After printing the first set of dots, the first set of printing elements is deactivated, and a second set of printing elements from the second bank of elements has to be activated for printing the rest of the row of dots. After printing the second set of dots, the second set of printing elements is deactivated. This process is repeated to print another row of dots until the entire row of characters is printed on the media. During the printing process, the print media is continually moving across a media or paper path. The rate that the dots are printed out corresponds to the distance that it is moved while printing. Once the row of characters is printed, the paper is advanced so that another row of characters or other information can be printed as the process is repeated.

The size and shape of the dots is a function of the shape of the printing element, the temperature of the printing element and the length of time the printing element is applied to the media or to the ribbon.

For printing a dot on the media, the respective printing element has to be supplied with electrical power for a sufficient length of time to heat up the printing element up to a predetermined printing temperature and to keep this printing temperature for a predetermined length of time. More precisely, for printing a dot, the printing element must rise to the predetermined printing temperature which is sufficient to alter the characteristics of the medium and stay at this temperature for a predetermined period of time to complete the printing of the dot. Consequently, the temperature of the printing element and the amount of heat applied by this printing element is dependent upon the level of drive current supplied to the printing element and the length of time the drive current is being supplied to the printing element.

A well known method for heating up the printing elements is "normal pulsing", i.e. a printing element is supplied with a single long drive current pulse of predetermined pulse width and pulse amplitude. The graph of such a pulse is illustrated in FIG. 3. The y or vertical axis represents the pulse amplitude and the x or horizontal axis represents units of time. In a thermal in-line printer, normal pulsing is performed by supplying a long drive current pulse to a first set of printing elements in the first bank of dots, and then supplying a long drive current pulse to a second set of printing elements in a second bank of dots. Consequently, not every element will be activated in a bank of elements. A "set" of elements refers to those elements within a particular bank of elements that will be activated or used in the process to print a row of dots. The set of elements will vary within the banks depending on the characters in the row to be printed.

FIG. 3 shows an example for "normal pulsing" of the current pulses to two successive sets of printing elements in a printhead. The pulse curve for the first set in the first bank of elements is 304. The pulse curve for the second set in the second bank of elements is 306. As an example of normal pulsing, a printing element of the first set of printing elements is turned on for 10 units of time (first current pulse 301). After completion of pulse 301, i.e. when the first set of dots is printed, a second current pulse 302 is supplied to a second set of printing elements. Since the row of dots is comprised of both sets of dots, the entire row is printed once both sets of dots have been printed.

The process is repeated for the next row of dots until the entire row of characters is printed on the media. During this time, the paper or media is constantly moving along the paper path. The sets of dots are printed separately while the media is moving. Thus, there is a slight shift between the sets of dots. However, the distance between the dot sets is small and is not perceptible to the human eye.

Heating the printing elements by using normal pulsing (i.e., by supplying the printing elements with a single long drive current pulse) has the drawback of making some printing elements hotter than they need to be. A first portion of pulse 301 is used to heat up the respective printing element to a predetermined printing temperature necessary for altering the characteristics of the media or for melting the ink of the ribbon. This portion is represented in FIG. 3 as that portion of pulse 301 between points 305 and 307 once the correct temperature has been achieved. A second portion of pulse 301 is necessary to apply the heat of the printing elements to the media for a length of time long enough for printing a dot on the media. In FIG. 3, this portion is represented by the portion from point 307 to point 309. During the second portion of the pulse 301, the temperatures of the printing elements are increasing. By the end of pulse 301 (i.e., at point 309) the printing elements have overheated or become "hotter" than they need to be. The overheating of the printing elements stresses the printhead which may result in shortening the working life of the thermal printhead. It also creates "bleeding" of the dots into the next dot row because the print elements exceed a temperature that is above the minimum print temperature necessary for printing. This temperature is maintained even after the electrical signal is removed from the element.

The standard solution for this problem is pulse modulation. In a first step, a first set of printing elements is supplied with a first current pulse to heat up the printing element to the printing temperature. Then, in a second step, the first set of printing elements is supplied with a sequence of shorter current pulses to maintain the temperature of the first set of printing elements at the printing temperature. The graph of this procedure for printing two banks of elements is illustrated in FIG. 4. After completion of the second step, i.e. after printing a first set of dots from the first bank of dots, a long pulse and series of short bursts are then applied to the second set of elements in the second bank in order to complete printing of the row of dots.

FIG. 4 shows an example of "pulse modulation" for printing two banks of elements. In pulse modulation, printing elements in the first set of printing elements are turned on for 6 units of time (first current pulse 401). By the end of pulse 401 (at point 405) these printing elements have reached their printing temperature. Thereafter, these printing elements are supplied with a sequence of short current pulses 402*a* to 402*d* to maintain the printing temperature of these printing elements to just above the minimum temperature required for printing. Overheating of these printing elements are, therefore, avoided. After completion of pulse 402*d*, the first set of dots is printed. Then, a second current pulse 403 is supplied to a second set of printing elements in the second bank to complete the printing of a single row of dots. By the end of pulse 403 these printing elements have reached their printing temperature. Thereafter, these printing elements are supplied with a sequence of short current pulses 404*a* to 404*d* to maintain the printing temperature of these printing elements. Thus, sets of dots from both banks have been printed which completes the row of dots to be printed. Simultaneously, the paper is continuously moving along the paper path. This process is repeated for the next row of dots until the entire row of characters is printed on the media. Because pulse modulation keeps the elements to more of a constant temperature, the stress on the printhead is reduced. Furthermore, bleeding of the dots is also reduced which increases print quality.

As can be seen when comparing FIG. 3 to FIG. 4, the overall "ON-time", i.e the sum of the pulse width (ON-time) of pulse 401 and the pulse widths (ON-times) of the sequence of pulses 402*a* through 402*d*, is approximately the same as the pulse width (ON-time) of the long pulse 301 used in "normal pulsing". However, because the pulse modulation has some "OFF-times" during the second step, the overall time required for "pulse modulation" is greater than the overall time for "normal pulsing". This reduces the maximum speed of printing. In the example of FIG. 4, pulse modulation takes 40% more time than the normal pulsing illustrated in FIG. 3 obviously reducing the maximum speed of the printer.

What is needed, therefore, is a device and method which economically and simply increases the speed of printing by shortening the time period for activating the printing elements, and which prevents the stressing of the print elements due to excessive element temperature, and which prevents the creation of "bleed" of the dots into the next dot row due to excessive temperature of the print element.

SUMMARY OF THE INVENTION

The previously mentioned needs are fulfilled with the present invention. Accordingly, there is provided a thermal printer composed of an in-line thermal printhead for printing symbols or characters on a media surface as a series of dots, a drive system for moving the paper across the printhead, and print logic for outputting print signals to the printhead such that the printing elements are heated by way of interleave pulse modulation.

By mirror imaging the second pulse train and interleaving the short pulses for each bank of printing elements, the overall time for heating and retaining the printing temperature of successive sets of printing elements is reduced.

In an embodiment of the invention, in a first step, a first set of printing elements is supplied with a first current signal for heating the first set of printing elements up to the printing temperature. Then, in a second step, the first set of printing elements is supplied with a second current signal for retaining the printing temperature of the first set of printing elements for printing a first bank of dots. In a third step, before completion of supplying the second current signal to the first set of printing elements, a third current signal is supplied to a second set of printing elements for heating the second set of printing elements up to the printing temperature. After completion of the third current signal, a fourth current signal is supplied to the second set of printing elements to retain the printing temperature of the second set of printing elements for printing a second bank of dots. The row of dots is printed when both banks of dots have been printed and the paper is advanced for printing a next rows of dots. This process is repeated until the entire row of characters is printed on the media.

In an embodiment of the invention, the third current signal is supplied to the second set of printing elements after completion of the first current signal which is supplied to the first set of printing elements. The fourth current signal is supplied to the second set of printing elements after completion of the second current signal which is supplied to the first set of printing elements.

In an embodiment of the invention, at least one of the above current signals is a long current pulse, and the remaining current signals consist of a sequence of short current pulses. The short current pulses simultaneously supplied to the first and second set of printing elements are synchronized in a way that the ON-times of the short current pulses of the one pulse sequence are concurrent with the OFF-times of short current pulses of the other pulse sequence.

The interleave pulse modulation gives the printer the advantages of pulse modulation (longer printhead life and less "bleed"), without the disadvantage of reducing the speed of printing.

These and other features, and advantages, will be more clearly understood from the following detailed description taken in conjunction with the accompanying drawings. It is important to note that the drawings are not intended to represent the only form of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The principles of the present invention and their advantages are best understood by referring to FIGS. 1–2 and 5–6 of the drawings, in which like numbers designate like parts. In the following description, well-known elements are presented without detailed description in order not to obscure the present invention in unnecessary detail. For the most part, details unnecessary to obtain a complete understanding of the present invention have been omitted inasmuch as such details are within the skills of persons of ordinary skill in the relevant art. Details regarding control circuitry or mechanisms used to control the rotation of the various elements described herein are omitted, as such control circuits are within the skills of persons of ordinary skill in the relevant art.

Figure 1:
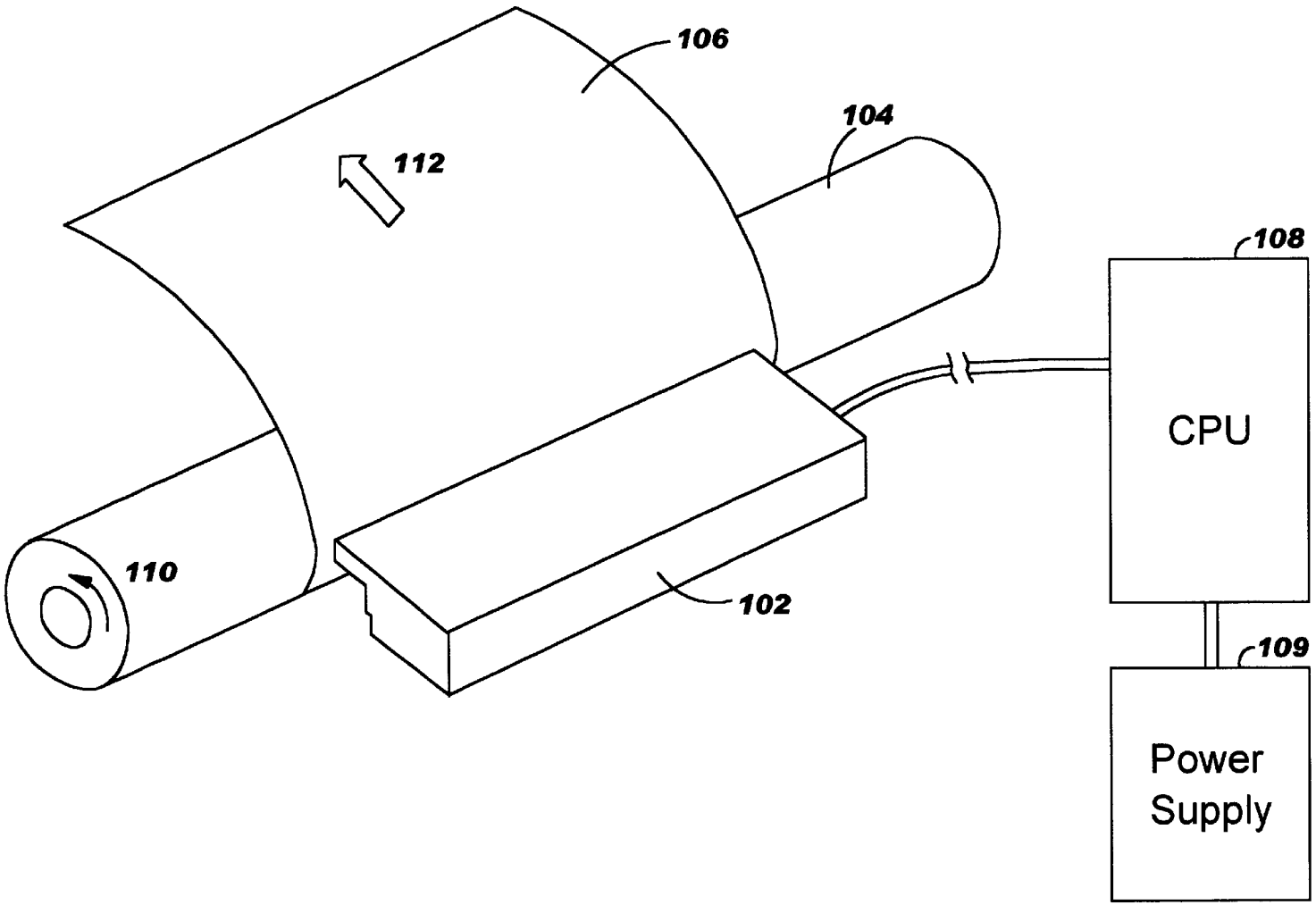
FIG. 1 is a schematic view of a thermal recording apparatus in which the present invention is applicable.

In FIG. 1, an in-line thermal printhead 102 is mounted in such a manner that it can be lowered against a platen roller 104. Thermal printhead 102 consists of a horizontal linear array of numerous printing elements (not shown) divided into two banks of elements. The printing elements individually generate heat by electrical power supplied by electric power supply 109 and are activated by printing signals from a control unit 108. A thermally sensitive recording medium 106, for example recording paper or a plastic sheet, is supported on platen roller 104. Platen roller 104 is rotated counterclockwise in direction 110 to advance recording medium 106 in succession in a direction 112. A system of gears (not shown) powered by a stepper motor (not shown) rotates platen roller 104.

Figure 2:
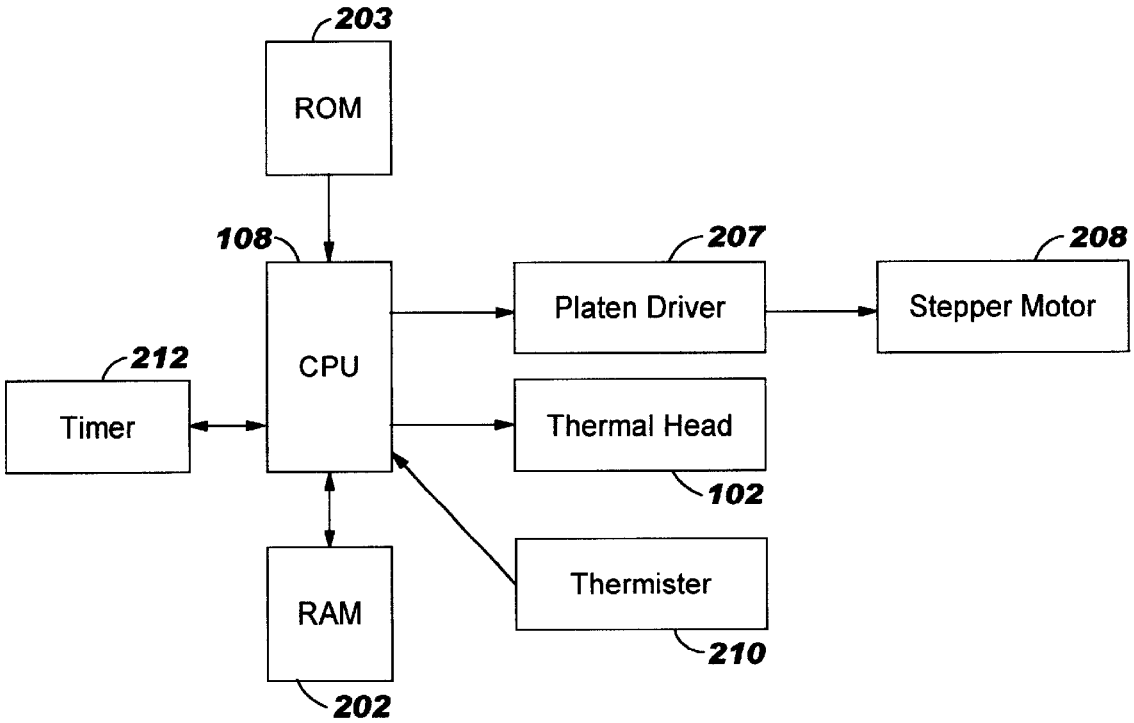
FIG. 2 is a block diagram showing a thermal printer according to the present invention.

FIG. 2 shows a block diagram for a thermal printer according to the present invention having a control unit 108, including a central processing unit (CPU) 201, a random access memory (RAM) 202 and a read-only memory (ROM) 203, a platen driver 207, a thermal printhead 102, a thermistor 210, a timer 212 and a stepper motor 208. The CPU 201 controls The printer in accordance with a program stored in ROM 203. CPU 201 serves to process data sent to the printer by a keyboard (not shown) or another CPU (not shown). The data to be printed is temporarily stored in the RAM 202. Then, in response to a printing command entered on a keyboard or another CPU, CPU 201 reads the data from the RAM 202, processes the data and sends the processed data or latch data to the platen driver 207 and the thermal printhead 102. The latch data are bits of information data stored in memory registers which represent the dots to be printed. Thermal printhead 102 has dot printing elements so that it may selectively pass current through the dot printing elements corresponding to the horizontal array of data. Each time the horizontal array of dot printing elements fishes its selective heating, CPU 201 sends out a motor-driving pulse to a platen driver 207 so that platen driver 207 can operate the stepper motor 208, thereby moving platen 104 in relation to thermal printhead 102.

Thermistor 210 is an electrical resistor making use of a semiconductor whose resistance varies sharply in a known manner with temperature. When incorporated into an electrical circuit, CPU 201 can determine changes in the temperature by reading changes in voltage. Thus, to those who practice the relevant art, thermistors are typically used as temperature measuring devices.

Timer 212 is a register (high-speed memory circuit) or a special circuit, chip, or software routine used to measure time intervals. Such devices are well known to those who practice the art.

Figure 5:
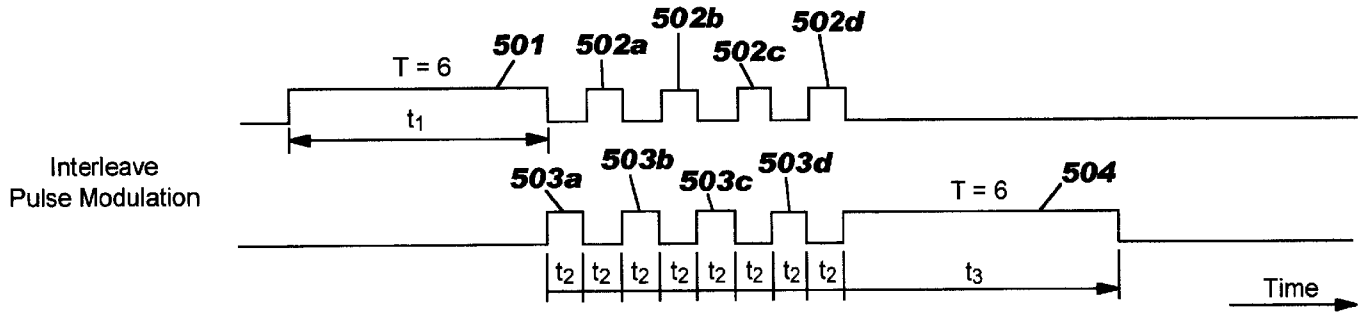
FIG. 5 is a diagrammatical view of the "interleave pulse modulation" according to the present invention.

FIG. 5 shows an example of "interleave pulse modulation" used in the present invention. In interleave pulse modulation, the selected elements of the first bank of printing elements are turned on for 6 units of time (first current pulse 501). By the end of pulse 501, the first set of printing elements has reached its printing temperature. Thereafter, the first set of printing elements is supplied with a sequence of short current pulses 502*a* to 502*d* to retain the printing temperature. The temperature and length of pulses at the completion of pulse 502d are sufficient to print the set of dots for bank 1. Therefore, overheating of these printing elements is avoided.

Additionally, after completion of pulse 501, a sequence of short current pulses 503*a* to 503*d* is supplied to the selected elements of the second bank. Pulses 503*a* through 503*d* are interleaved with pulses 502*a* through 502*d* (which are supplied to the selected elements in the first bank). By the end of current pulse 503*d*, printing elements from the second bank have increased their printing temperature. Thereafter, printing elements from the second bank receive a longer pulse 504 to reach and retain their printing temperature for a length of time sufficient to print the set of dots from the second bank of elements. This process is repeated until the entire row of characters is printed on the media.

The exact length of time for all current pulses and the number of short pulses (pulses 502*a* through 502*d* and pulses 503*a* through 503*d*) are determined empirically and are functions of the characteristics of the print elements and power supplies. As one can see from FIG. 5, by using interleaved pulse modulation, the advantages of pulse modulation are achieved without the drawback of reducing the speed of printing. Further, the printhead life will be increased compared to similar printers with no modulation.

Figure 6:
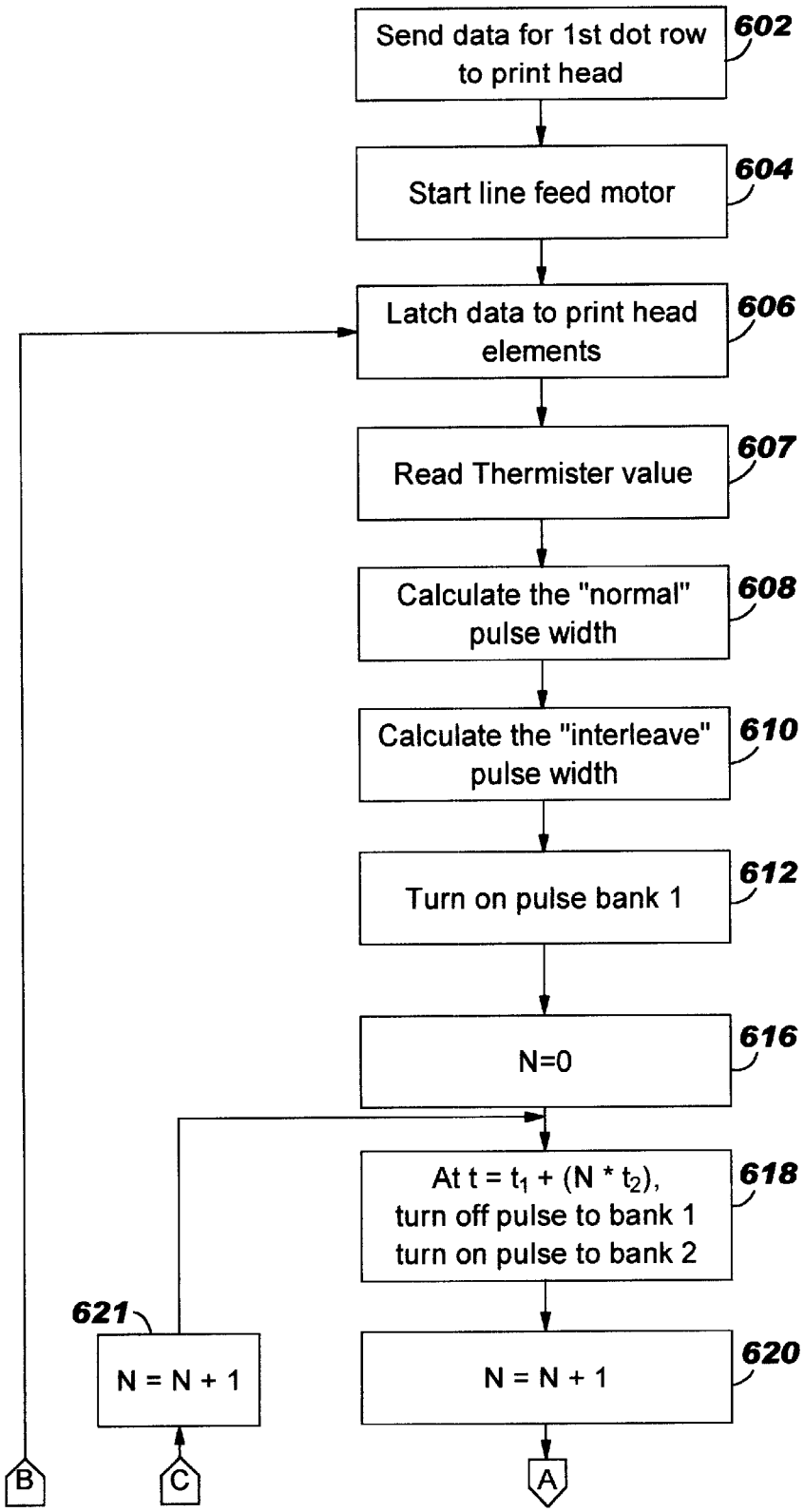
FIG. 6 is a flow chart showing the control sequence and print logic for the "interleave pulse modulation" according to the present invention.

In operation, printing control unit 108 operates according to logic expressed in the flow chart shown in FIG. 6. Initialization data is sent to the printhead in step 602, which starts stepper motor 208 (see FIG. 2) as step 604. Latch data is then sent to the printhead elements in step 606. The data is either 0 or 1 which corresponds to whether the printhead element will be energized.

Figure 3:
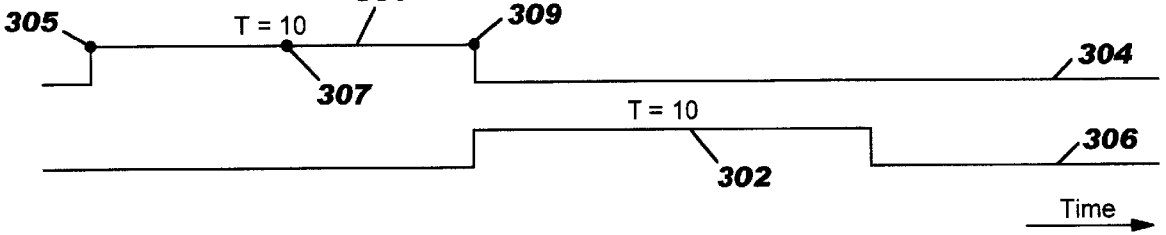
FIG. 3 (Prior Art)
FIG. 3 is a diagrammatical view of the "normal pulsing" according to prior art.
Figure 4:
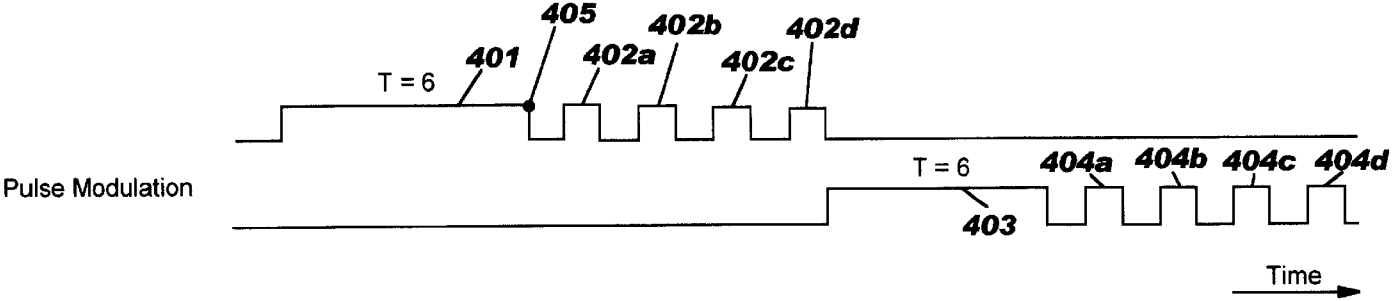
FIG. 4 (Prior Art)
FIG. 4 is a diagrammatical view of the "pulse modulation" according to prior art.

In step 607, the thermistor value is read. In step 608, the "normal pulse" width is calculated, The normal pulse is graphically displayed as the length of pulse 301 in FIG. 3. The normal pulse width can be calculated according to the formula:

Normal Pulse Width=Base Pulse Width−(Thermistor Temperature*Slope)

The values of the base pulse and the slope are dependent upon the specific printhead and are determined by empirical testing. Such testing methods are well known by those who practice the relevant art.

Next, in step 610, the "interleave" pulse widths are calculated. The interleave pulse widths are percentages of the Normal Pulse Width. The number of interleave pulses and length of such pulses to achieve the best print quality are a function of the printhead and power supply. As such, these percentages should be determined empirically for each printhead and power supply combination. The possible ranges for such widths are:

$t_1$=between 10% and 90% of the Normal Pulse Width $t_2$=between 5% and 25% of the Normal Pulse Width $t_3$=between 10% and 90% of the Normal Pulse Width Empirical data used in the present invention suggest the following formulas will yield optimal printing results:

$t_1$=60% of the Normal Pulse Width $t_2$=10% of the Normal Pulse Width $t_3$=65% of the Normal Pulse Width The variable $t_1$ corresponds to the length of time a printhead is energized and is graphically represented in FIG. 5 as the length of pulse 501. Similarly, $t_2$ corresponds to the length of pulses 502*a* through 502*d*, and $t_3$ corresponds to the length of pulse 503.

Figure 6A:
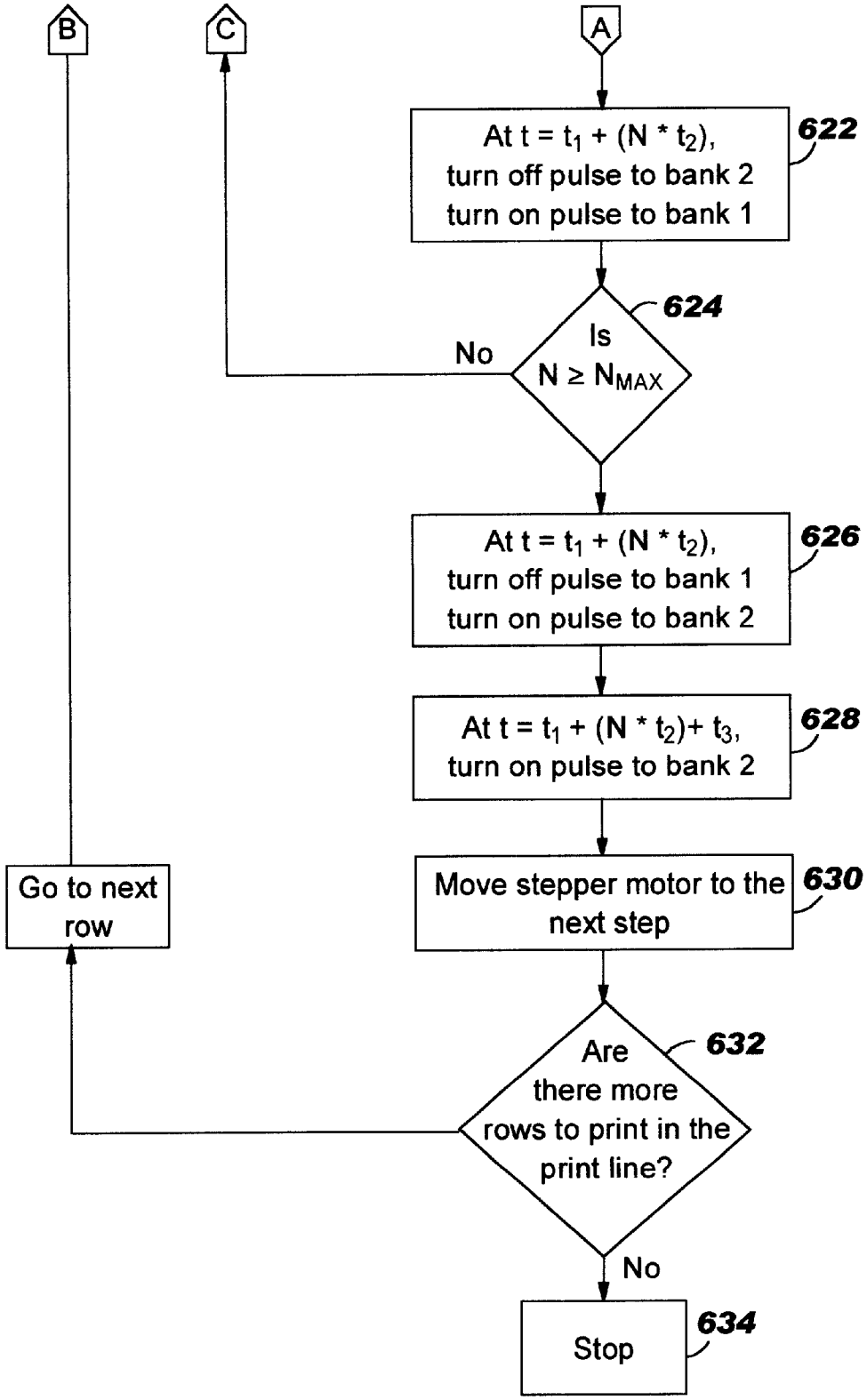
FIG. 6*a* is a continuation of the flow chart illustrated in FIG. 6.

Pulse 501 is then sent to the first set of print elements in the first bank of print elements (step 612). Step 616 sets the counter N to zero. At step 618 which is performed when the time is $t_1+(N*t_2)$, the pulse sent to bank 1 is turned off and the pulse to bank 2 is turned on. When N is zero, time is $t_1$ which corresponds to the end of pulse 501 and the beginning of pulse 503*a* in FIG. 5. Step 620 increments counter N by one. Then at step 622 (FIG. 6*a*), which is performed when the time is $t_1+(N*t_2)$, the pulse sent to bank 2 is turned off and the pulse sent to bank 1 is turned on.

Step 624 is a decision step to test whether counter N has reached the predetermined or maximum number of times the interleaved group of pulses 502 and 503 are turned on and off ("$N_{max}$"). If $N_{max}$ has not been reached, the logic increments the counter N by one in step 621 and loops back to step 618. The looping back has the effect of turning on a pulse to one of the banks while simultaneously turning off a pulse to the other bank. In other words, the pulses sent to both banks are interleaved in time as shown on FIG. 5 as pulses 503*a* through 503*d* and 502*a* through 502*d*. On the other hand, if N has reached the value for $N_{max}$, step 626 is performed when time equals $t_1+(N*t_2)$. Step 626 is shown in FIG. 5 as the beginning of pulse 504 and the end of pulse 502*d*. At step 626, the pulse to bank 1 is turned off and a pulse to bank 2 is turned on. Thus, printing has now been accomplished for bank 1 and it is no longer necessary to send pulses to the elements in bank 1.

The elements of bank 2 have been preheated by the series of pulses 503*a* through 503*d*. As such, pulse 504 is turned on, but only needs to be long enough to maintain the desired temperature for printing. Thus, at step 628, which occurs at time $t_1+(N*t_2)+t_3$, pulse 504 (FIG. 5) is turned off and printing is completed for the dots of bank 2. Because the dots from both bank 1 and bank 2 have been printed, recording medium 106 can be advanced by signaling stepper motor 208 (FIG. 2) (step 630).

Step 632 is another decision step to determine if there are more rows of dots to be printed in the current row of characters. If there are more rows, the logic loops back to step 606 so the next row of dots can be printed. If there are no more rows of dots, recording medium 106 is advanced so that either a new row of characters can be printed or positioned as required when the printing process is finished (step 634).

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It is therefore, contemplated that the claims will cover any such modifications or embodiments that fall within the true scope of the invention.

What is claimed is:

1. A method for printing on a print medium using a first bank and a second bank of thermal print elements comprising the steps of:

a. sending a pulse to energize a first set of selected print elements in the first bank;

b. sending a pulse to energize a second set of selected print elements in the second bank;

c. sending a pulse to energize the first set of selected print elements in the first bank;

d. repeating steps (b) and (c) until the first set of selected print elements in the first bank have been energized for a sufficient length of time to print dots on the print medium;

e. sending a pulse to energize the second set of selected print elements of the second bank for a sufficient length of time at a predetermined temperature to print dots on the print medium.

2. The method of claim 1, further comprising the step of calculating a normal pulse width.

3. The method of claim 2, wherein the pulse of step (a) has a pulse width ($t_1$) substantially equal to between 0.1 and 0.9 times the normal pulse width.

4. The method of claim 2, wherein the pulses of steps (b) and (c) have a pulse width ($t_2$) substantially equal to between 0.05 and 0.25 times the normal pulse width.

5. The method of claim 2, wherein the pulse of step (e) has a pulse width ($t_3$) substantially equal to between 0.1 and 0.9 times the normal pulse width.

6. The method of claim 2, wherein the calculation step further comprises the subsets of:

a. reading a value from a thermistor attached to a printhead;

b. calculating the printhead temperature from the thermistor value;

c. multiplying the printhead temperature by the value of the slope; and d. subtracting the resulting value of sub-step (c) from the base pulse to determine the value of the normal pulse width.

7. The method of claim 1, wherein the repeating step is repeated four times.

8. A method for printing on a print medium using a first bank and a second bank of thermal print elements comprising the steps of:

a. sending an electrical current to a first set of selected print elements in the first bank;

b. ending an electrical current to the first set of selected print elements in the first bank at a predetermined time and sending an electrical current to a second set of selected print elements in the second bank;

c. ending the electrical current to the second set of selected print elements in the second bank at a predetermined time and sending an electrical current to the first set of selected print elements in the first bank;

d. repeating steps (b) and (c) for a predetermined number of times;

e. ending the electrical current to the first set of selected print elements in the first bank at a predetermined time and sending an electric current to the second set of selected print elements of the second bank; and f. ending the electrical current to the second set of print elements in the second bank at a predetermined time.

9. The method of claim 8, further comprising the step of calculating a normal pulse width which comprises the substeps of:

a. reading a value from a thermistor attached to a printhead;

b. calculating the printhead temperature from the thermistor value;

c. multiplying the printhead temperature by the value of the slope; and d. subtracting the resulting value of sub-step (c) from the base pulse to determine the value for the normal pulse width.

10. The method of claim 8, further comprising the step of calculating the pulse width of step (a) according to the following formula: pulse width ($t_1$)=A*normal pulse width, where A is between 0.1 and 0.9.

11. The method of claim 8, further comprising the step of calculating the pulse width of steps (b) and (c) according to the following formula: pulse width ($t_2$)=B*normal pulse width, where B is between 0.05 and 0.25.

12. The method of claim 8, further comprising the step of calculating the pulse width of step (e) according to the following formula: pulse width ($t_3$)=C*normal pulse width, where C is between 0.1 and 0.9.

13. The method of claim 8, further comprising the step of initializing a counter to zero.

14. The method of claim 13, further comprising the step of incrementing the counter by one between the steps of (b) and (c).

15. The method of claim 14, wherein step (d) further comprises the step of incrementing the counter by one.

16. The method of claim 15, wherein the predetermined time of step (b) is calculated according to the formula:

Predetermined Time=$t_1$+(N*$t_2$), where N is the value of the counter.

17. The method of claim 16, wherein the predetermined time of step (c) is calculated according to the formula:

Predetermined Time=$t_1$+(N*$t_2$), where N is the value of the counter.

18. The method of claim 17, wherein the predetermined time of step (e) is calculated according to the formula:

Predetermined Time=$t_1$+(N*$t_2$), where N is the value of the counter.

19. The method of claim 18, wherein the predetermined time of step (f) is calculated according to the formula:

Predetermined Time=$t_1$+(N*$t_2$)+$t_3$, where N is the value of the counter.

20. A method for printing on a print medium using a printer comprising a printhead comprising a thermistor, and a first bank and a second bank of thermal print elements, and a line feed motor, the method comprising the steps of:

a. sending data for a first row of dots to the printhead and sending latch data to individual the printhead elements;

b. reading the thermistor value and calculating the printhead temperature;

c. calculating a normal pulse width for the print elements;

d. calculating a interleave pulse width for the print elements;

e. sending an electric current to selected print elements in the first bank;

f. setting a counter to zero;

g. stopping the electric current to selected print elements in the first bank and sending an electric current to selected print elements in the second bank at a predetermined time;

h. incrementing the counter by one;

i. stopping the electric current to selected print elements in the second bank and sending an electric current to selected print elements in the first bank at a predetermined time;

j. determining whether the counter has reached a predetermined maximum value, if not, repeating steps (g) through (j);

k. stopping the electric current to selected print elements in the first bank and sending an electric current to selected print elements in the second bank at a predetermined time; and l. stopping the electric current to selected print elements in the second bank at a predetermined time.

21. The method of claim 20, further comprising the step of starting a line feed motor before the step of sending data to the printhead.

22. The method of claim 20, further comprising the following steps after step (I):

a. advancing the print medium to next printer position; and b. determining whether there are more rows of dots to print in the print line, if yes, then looping back to step (a).

23. The method of claim 20, wherein the step of calculating the normal pulse width further comprises sub-steps of:

a. multiplying the printhead temperature by the value of the slope; and b. subtracting the resulting value of sub-step (a) from the base pulse to determine the value for the normal pulse width.

24. The method of claim 23, wherein the step of calculating the interleave pulse widths comprises the sub-steps of:

a. determining value of the first pulse width ($t_1$) according to the formula:

$t_1$=A*(Normal Pulse Width), where A is a value between 0.1 and 0.9;

b. determining the value of the interleave pulse widths ($t_2$) according to the formula:

$t_2$=B*(Normal Pulse Width), where B is a value between 0.05 and 0.25; and c. determining the value of the last pulse width ($t_3$) according to the formula:

$t_3$=C*(Normal Pulse Width), where C is a value between 0.1 and 0.9.

25. The method of claim 24, wherein the predetermined time of step (g) is calculated according to the formula:

Predetermined Time=$t_1$+(N*$t_2$), where N is the value of the counter.

26. The method of claim 24, wherein the predetermined time of step (I) is calculated according to the formula:

Predetermined Time=$t_1$+(N*$t_2$), where N is the value of the counter.

27. The method of claim 24, wherein the predetermined time of step (g) is calculated according to the formula:

Predetermined Time=$t_1$+(N*$t_2$), where N is the value of the counter.

28. The method of claim 24, wherein the predetermined time of step (k) is calculated according to the formula:

Predetermined Time=$t_1$+(N*$t_2$), where N is the value of the counter.

29. The method of claim 24, wherein the predetermined time of step (I) is calculated according to the formula:

Predetermined Time=$t_1$+(N*$t_2$)+$t_3$, where N is the value of the counter.

30. An apparatus for in-line thermal printing comprising:

a printhead having a first bank and a second bank of dot print elements; and a processing unit in communication with said printhead, said processing unit executing a program sequence that interleaves electric current to said first bank of print elements with said second bank of print elements such that temperature of said print elements is limited while maintaining a printing speed.

31. The apparatus of claim 30, wherein said program sequence comprises the steps of:

a. sending a pulse to energize a first set of selected print elements in the first bank;

b. sending a pulse to energize a second set of selected print elements in the second bank;

c. sending a pulse to energize the first set of selected print elements in the first bank;

d. repeating steps (b) and (c) until the first set of selected print elements in the first bank have been energized for a sufficient length of time to print dots on the print medium;

e. sending a pulse to energize the second set of selected print elements of the second bank for a sufficient length of time at a predetermined temperature to print dots on the print medium.

32. The apparatus of claim 31, further comprising a thermistor coupled to said printhead and in electronic communication with said processing unit.

33. The apparatus of claim 31 wherein said logic further comprises the step of calculating a normal pulse width.

34. The apparatus of claim 31, wherein the pulse of step (a) has a pulse width ($t_1$) substantially equal to between 0.1 and 0.9 times the normal pulse width.

35. The apparatus of claim 31, wherein the pulses of steps (b) and (c) have a pulse width ($t_2$) substantially equal to between 0.05 and 0.25 times the normal pulse width.

36. The apparatus of claim 31, wherein the pulse of step (e) has a pulse width ($t_3$) substantially equal to between 0.1 and 0.9 times the normal pulse width.

37. The apparatus of claim 31, wherein the repeating step is repeated four times.

38. The apparatus of claim 31, wherein the calculation step further comprises the subsets of:

a. reading a value from a thermistor attached to the printhead b. calculating the printhead temperature from the thermistor value, c. multiplying the printhead temperature by the value of the slope; and d. subtracting the resulting value of sub-step (c) from the base pulse to determine the value of the normal pulse width.

39. A thermal printer, comprising:

a printhead having a series of dot printing elements separated into a first bank and a second bank of dot printing elements;

a digital memory containing instructions for a drive system and a print logic for interleaving electric currents between said first bank and said second bank of print elements such that said power required to print said print signals does not exceed a predetermined power level; and a processing unit in communication with said digital memory, such processing unit is capable of executing print logic from said digital memory and directing print signals to said dot printing elements.

40. The printer of claim 39, wherein said print logic further comprises circuitry operable for:

a. sending a pulse to energize a first set of selected print elements in the first bank;

b. sending a pulse to energize a second set of selected print elements in the second bank;

c. sending a pulse to energize the first set of selected print elements in the first bank;

d. repeating steps (b) and (c) until the first set of selected print elements in the first bank have been energized for a sufficient length of time to print dots on the print medium;

e. sending a pulse to energize the second set of selected print elements of the second bank for a sufficient length of time at a predetermined temperature to print dots on the print medium.

41. The printer of claim 40, further comprising a thermistor coupled to said printhead and in electronic communication with said processing unit.

42. The printer of claim 40 wherein said logic further comprises circuitry for calculating a normal pulse width.

43. The printer of claim 40, wherein the pulse of step (a) has a pulse width ($t_1$) substantially equal to between 0.1 and 0.9 times the normal pulse width.

44. The printer of claim 40, wherein the pulses of steps (b) and (c) have a pulse width ($t_2$) substantially equal to between 0.05 and 0.25 times the normal pulse width.

45. The printer of claim 40, wherein the pulse of step (e) has a pulse width ($t_3$) substantially equal to between 0.1 and 0.9 times the normal pulse width.

46. The printer of claim 40, wherein the repeating step is repeated four times.

47. The printer of claim 40, wherein the calculation step further comprises the subsets of:

a. reading a value from a thermistor attached to the printhead b. calculating the printhead temperature from the thermistor value, c. multiplying the printhead temperature by the value of the slope; and d. subtracting the resulting value of sub-step (c) from the base pulse to determine the value of the normal pulse width.

* * * * *